US006779589B2

(12) United States Patent
Blucher et al.

(10) Patent No.: US 6,779,589 B2
(45) Date of Patent: Aug. 24, 2004

(54) METHOD FOR THE PRODUCTION OF INORGANIC FIBER-REINFORCED METAL MATRIX COMPOSITE WIRES

(75) Inventors: Joseph T. Blucher, Waltham, MA (US); Makoto Katsumata, Susono (JP)

(73) Assignees: Yazaki Corporation, Shizuoka (JP); Northeastern University, Boston, MA (US)

( * ) Notice: Subject to any disclaimer, the term of this patent is extended or adjusted under 35 U.S.C. 154(b) by 131 days.

(21) Appl. No.: 10/373,979

(22) Filed: Feb. 25, 2003

(65) Prior Publication Data

US 2004/0020627 A1 Feb. 5, 2004

Related U.S. Application Data

(62) Division of application No. 09/824,907, filed on Apr. 3, 2001, now Pat. No. 6,629,557.

(60) Provisional application No. 60/194,529, filed on Apr. 4, 2000.

(51) Int. Cl.[7] ..... B22D 19/04; B05D 1/18; B05D 3/10

(52) U.S. Cl. ..... 164/461; 164/97; 427/431; 427/299; 427/434.2; 427/434.6; 427/434.7

(58) Field of Search ..... 164/97, 98, 461, 164/419; 427/299, 314, 431, 434.2, 434.6, 434.7

(56) References Cited

U.S. PATENT DOCUMENTS

| | | | | |
|---|---|---|---|---|
| 3,090,352 A | | 5/1963 | Knapp | 118/405 |
| 3,654,897 A | | 4/1972 | Trattner et al. | 118/69 |
| 4,082,864 A | | 4/1978 | Kendall et al. | 427/225.24 |
| 4,659,593 A | | 4/1987 | Rocher et al. | 427/310 |
| 4,779,563 A | | 10/1988 | Ishikawa et al. | 118/612 |
| 4,948,406 A | | 8/1990 | Kornmann | 65/431 |
| 5,049,419 A | * | 9/1991 | Kyono et al. | 427/251 |
| 5,736,199 A | | 4/1998 | Blucher | 427/430.1 |
| 6,035,925 A | | 3/2000 | Blucher | 164/419 |
| 6,245,425 B1 | | 6/2001 | McCullough et al. | 428/379 |
| 6,329,056 B1 | | 12/2001 | Deve et al. | 428/389 |
| 6,460,597 B1 | | 10/2002 | McCullough et al. | 164/91 |
| 6,485,796 B1 | | 11/2002 | Carpenter et al. | 427/601 |
| 6,524,658 B2 | | 2/2003 | Murofushi et al. | 427/431 |
| 6,629,557 B2 | * | 10/2003 | Blucher et al. | 164/97 |

FOREIGN PATENT DOCUMENTS

| | | | |
|---|---|---|---|
| EP | 0436807 A1 | 7/1991 | B22D/19/14 |
| JP | 01-145 352 | 6/1989 | C03C/25/04 |
| JP | 04-176 851 | 6/1992 | C23C/2/00 |
| JP | 08-76 701 | 7/1996 | C22C/1/09 |

* cited by examiner

*Primary Examiner*—M. Alexandra Elve
*Assistant Examiner*—Kevin P. Kerns
(74) *Attorney, Agent, or Firm*—Weingarten, Schurgin, Gagnebin & Lebovici LLP

(57) ABSTRACT

A method and apparatus for manufacturing composite materials are provided. In a first embodiment, a binding material is placed on a heat-resistant filter that is placed on hollow particles in a pressurizable container. Under pressure and heat, the binding material flows through the filter and infiltrates the spaces between the hollow particles. In a further embodiment, composite material wire is produced by coating the surfaces of inorganic fiber bundles with a metal oxide by dipping in a solution of a hydrolyzable organic metal compound and hydrolyzing and heat-treating prior to continuous infiltration under pressure.

11 Claims, 8 Drawing Sheets

METHOD FOR THE PRODUCTION OF INORGANIC FIBER-REINFORCED METAL MATRIX COMPOSITE WIRES

CROSS REFERENCE TO RELATED APPLICATIONS

This application claims the benefit under 35 U.S.C. § 120 of U.S. application Ser. No. 09/824,907 filed Apr. 3, 2001, now U.S. Pat. No. 6,629,557, and 35 U.S.C. § 119(e) of U.S. Provisional Application No. 60/194,529, filed on Apr. 4, 2000, the disclosures of which are incorporated by reference herein.

STATEMENT REGARDING FEDERALLY SPONSORED RESEARCH OR DEVELOPMENT

N/A

BACKGROUND OF THE INVENTION

It is known that materials with superior strength and abrasion-resistance may be developed as composite materials by embedding such reinforcing materials as carbon-based fibers, ceramic-based fibers, or ceramic particles in a metal matrix material such as an aluminum alloy. Such metal matrix composite materials can be manufactured by a die-casting machine 100 such as that shown in FIGS. 1 and 2. In a precasting process, a preform 103 is sintered to a desired shape after inorganic fibers or ceramic particles are mixed with water, dehydrated and dried. The preform 103 is placed in a metal mold 101, while a plunger pump 102 is filled with a molten metal 104 of matrix material. Then a piston 105 forces the metal matrix material to infiltrate into the preform in the metal mold to create a metal matrix composite 106. The metal matrix composite may find various industrial applications including in airplanes and automobiles as a high-strength, light-weight composite material containing inorganic fibers or ceramic particles ranging from 10 to 50% by volume.

Such a manufacturing method of metal matrix composite materials has two problems. First, because the metal matrix composite is not formed in a hermetic state, chemical reactions such as decomposition, precipitation and metal oxidation occur during infiltration, leading to deterioration in the strength characteristics of the composite. Also, when hollow particles are used as a filling material, gravity (buoyancy)-induced particle separation may occur during metal infiltration, making it difficult to manufacture composite materials with a high content of hollow particles.

Fiber-reinforced composite wires manufactured through the infiltration of metals into inorganic (carbon, ceramics, metals, etc.) fiber bundles may also find many industrial applications. Fiber-reinforced composite wires are known to exhibit superior characteristics in durability and reliability. To this end, a molten metal must infiltrate into the interfiber spacing and increase the overall metal volume percentage. One process for the production of such fiber-reinforced composite wires of the required quality is described in U.S. Pat. No. 5,736,199, the disclosure of which is incorporated by reference herein.

This continuous infiltration process uses a metal infiltration apparatus 200 as shown in FIGS. 3 and 4. This apparatus is comprised of a pressure chamber 201 and a bath container 203 for a molten metal 202, such as aluminum, aluminum alloy, or copper. The bath container is heated by a heater 204 and is equipped with an entering orifice 205 at a bottom surface 201a of the pressure chamber and an intermediate orifice 207 for passing inorganic fiber bundles through the bath container for metal infiltration. The entering orifice, connected to a bottom surface 203*a* of the bath container, allows inorganic fiber bundles 210 to enter the bath container. The intermediate orifice extends from a position within the molten metal to a closure member 206 that covers the opening section of the bath container. Furthermore, an exit orifice 208, provided at an upper surface 201*b* of the pressure chamber, allows the metal-infiltrated inorganic fiber bundles to exit from the pressure chamber.

Referring to FIG. 4, functions of the orifices will be described by taking the entering orifice 205 as an example. The orifice is cylindrical in shape, and the exterior surface of the orifice is covered with a cooling jacket 214. An insertion hole 205*b* is formed along the central axis of an orifice body 205*a* and has an inside diameter slightly greater than the outside diameter of fiber bundles 210 that travel upwardly into the insertion hole. A temperature gradient is provided along the orifice such that the temperature is above the melting temperature of the material in the bath nearest the bath container and below the melting temperature farthest from the bath chamber.

A non-reacting gas, such as argon and nitrogen, is introduced into the pressure chamber 201 from a gas supply source 209. Thus, the interior spaces of both the pressure chamber and the bath container 203 are respectively maintained at preset pressures when the fiber bundles are infiltrated by metal.

In the infiltration apparatus having such a configuration, inorganic fiber bundles that are fed continuously from a bobbin 211 are introduced into the bath container by way of the entering orifice 205 and are brought into contact with the molten metal 202. Because the interior spaces of both the pressure chamber and the bath container are pressurized by a gas supplied from the gas supply source 209, the molten metal infiltrates into the interfiber spacing of the inorganic fiber bundles. The metal-infiltrated fiber bundles then leave the bath container 203 by way of the intermediate orifice 207.

While the inorganic fiber bundles travel through the inside of the pressure chamber 201, the molten metal that has adhered to and infiltrated into the inorganic fiber bundles is cooled, so that a part of the metal solidifies within and around the inorganic fiber bundles. Subsequently, a take-up bobbin 213 takes up a fiber-reinforced metal matrix composite wire 212 coming out of the pressure chamber 201 through the exit orifice 208.

The fiber-reinforced metal matrix composite wire thus produced should be impregnated with the metal in the interior as well as the surface of the bundles. However, for certain metal-fiber combinations with poor wetting characteristics, it is difficult to achieve metal infiltration deep into the interfiber spacing of fiber bundles.

Various efforts have been reported for better metal infiltration through improved wetting characteristics by surface-treating inorganic fiber bundles, including thermal CVD (chemical vapor deposition) reactors and vacuum vapor deposition reactors to deposit metal particles on the surface of fiber bundles. These surface treatments are not effective, however, in depositing metal particles deep within inorganic fiber bundles. Additional requirements of these reactors also increase the manufacturing cost of fiber-reinforced composite wires.

Additionally, when the diameter of a fiber-reinforced metal matrix composite wire produced by the above-described continuous infiltration method is reduced, the through holes of the orifices must become smaller accordingly, making it difficult to pass fiber bundles through holes in this method. Also, the walls of the through holes have been made of carbon-based materials such as graphite, which do not exhibit good durability against wear caused by the friction between the walls and the moving wire. If, on the other hand, the walls are made of materials with high resistance against abrasion, the fiber bundles become more vulnerable to breakage within the orifice.

SUMMARY OF THE INVENTION

In a first embodiment of the present invention, a method is provided of manufacturing high-strength, light-weight composite materials with a high content of hollow particles. In particular, the method provides a composite material comprising hollow particles with a mean particle size ranging from 10 to 100 $\mu$m and a metal as a binding agent. The binding material is placed on top of a layer of hollow particles in a pressurizable container. The binding material is separated from the layer of hollow particles by a heat-resistant filter securely fixed at a position between the two materials. After evacuating the pressurizable container, the binding material is heated until it melts completely. The pressurization of the pressurizable container from above, preferably by injection of an inert gas, forces the binding agent to infiltrate into the spaces between the hollow particles.

Preferably, the hollow particles are either ceramic-based hollow particles, particularly, silas balloons, glass balloons, or alumina balloons, or carbon balloons. Preferably, the binding agent comprises gold, silver, copper, tin, iron, cobalt, nickel, lead, aluminum, or their alloys. Preferably, the heat-resistant filter is a ceramic-based filter, in particular, formed from a mullite-based material.

After the pressurization step, the resulting composite material is cooled to a predetermined temperature. Preferably, the composite material is cooled rapidly to achieve finer metal grains, which improve the strength of the composite material. The metal-based binding agent is charged with the ceramic-based hollow particles at a charging ratio of 50% by volume or greater, thus providing a light-weight, high-strength metal matrix composite.

In a further embodiment of the present invention, a method and an apparatus are provided for the continuous pressure infiltration of wire that facilitates insertion of fiber bundles into orifices, realizes superior workability, and ensures consistent wire quality by preventing breakage in the fiber bundles during the manufacturing process.

More particularly, the surfaces of inorganic fiber bundles are coated with a metal oxide by dipping the fiber bundles in a solution of a hydrolyzable organic metal compound and hydrolyzing and heat-treating the organic metal compound deposited on the fiber surfaces to form the metal oxide. The coated inorganic fiber bundles are passed through continuous pressure infiltration apparatus to infiltrate a molten metal into the fiber bundles.

Because metal oxides in general possess a high degree of affinity with metal, the metal oxide, formed uniformly on the surface of the fibers within the fiber bundles, facilitates the subsequent step of pressure infiltration of a molten metal deep into the inorganic fiber bundles. The combined steps of the pretreatment and the pressure infiltration allow the inorganic fiber bundles to be fully impregnated with the molten metal in the bath container, thus producing fiber-reinforced metal matrix composite wires of the desired quality.

In a further embodiment, the continuous pressure infiltration apparatus is provided with orifices having enlarged diameter sections at the entering ends and also at the exit ends. The enlarged diameter sections allow the fibers to be more readily inserted and guided into the orifices. Also the interior surface of the passageways in the orifices are preferably finished with a mirror finish. The material of the orifices is selected to have a low reactivity with both the molten metal and the inorganic fiber bundles. Preferably, the orifices are formed from stainless steel, tantalum, molybdenum, platinum, tungsten, or sintered zirconia-ceramic-based materials.

In a still further embodiment, a pressure infiltration apparatus is provided with an ultrasonic generator made of a ceramic material that does not react with the molten metal in the bath container. Application of ultrasonic vibrations promotes the infiltration of molten metal within the fiber bundles.

DESCRIPTION OF THE DRAWINGS

The invention will be more fully understood from the following detailed description taken in conjunction with the accompanying drawings in which.

DETAILED DESCRIPTION OF THE INVENTION

Figure 1:
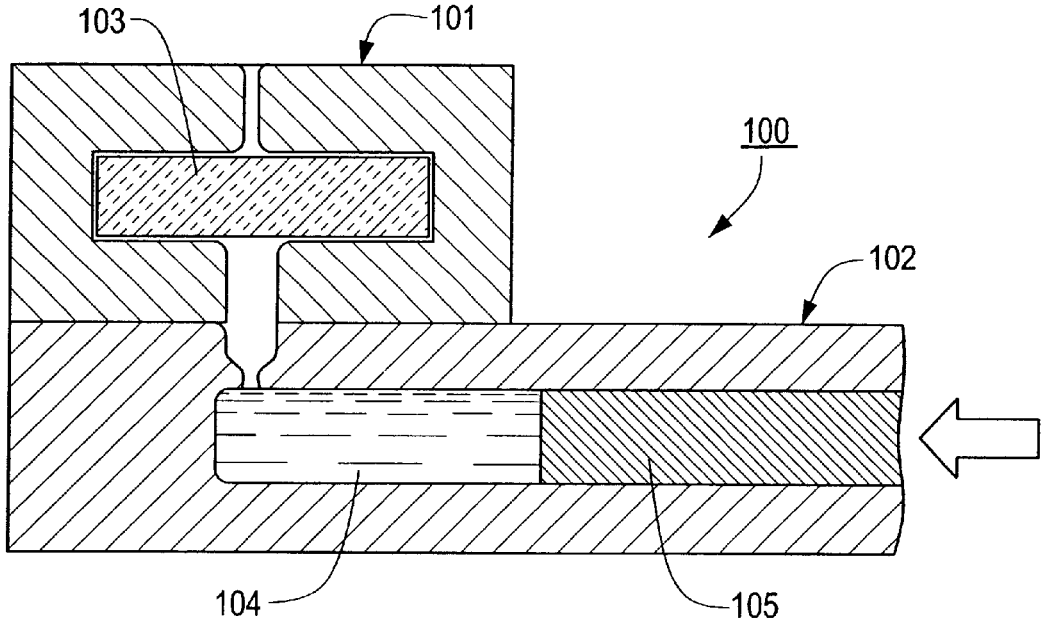
FIG. 1 PRIOR ART
FIG. 1 is a schematic diagram of a prior art method and apparatus of manufacturing a composite material.
Figure 2:
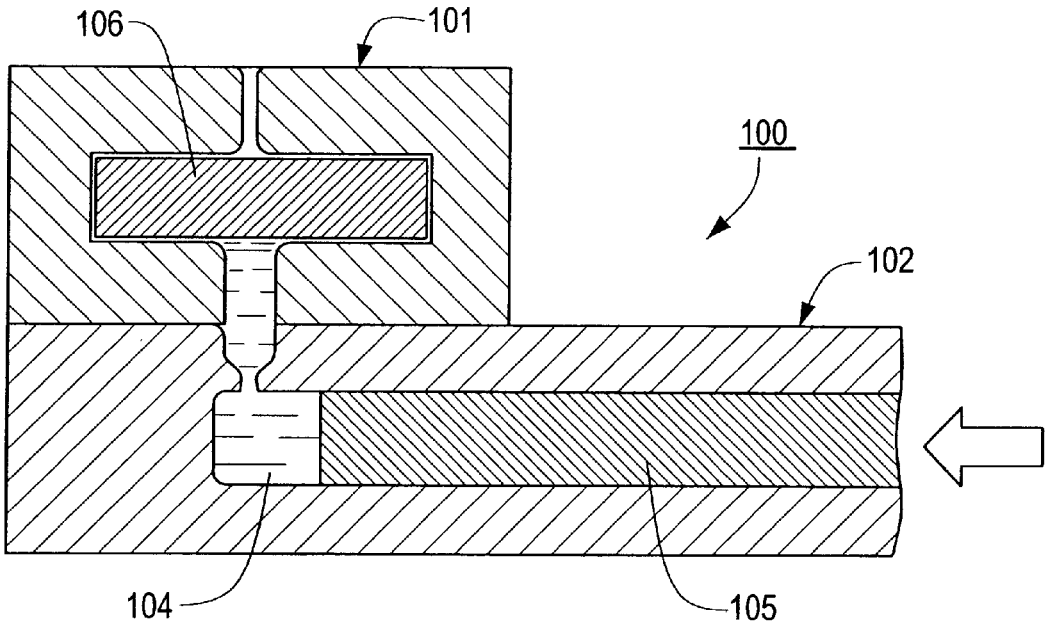
FIG. 2 PRIOR ART
FIG. 2 is a schematic diagram of the method and apparatus of FIG. 1 after completion of the steps illustrated by FIG. 1.
Figure 3:
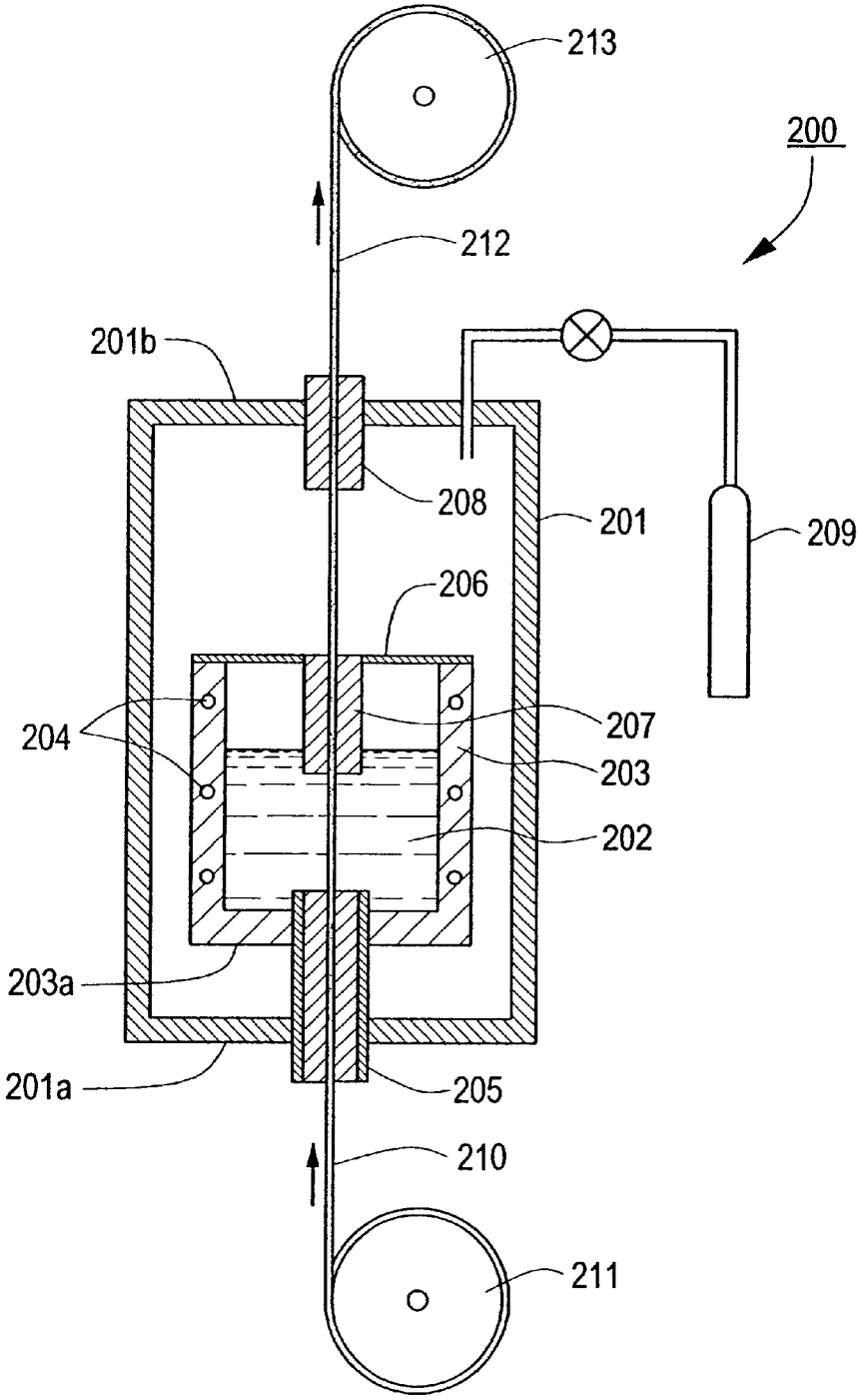
FIG. 3 PRIOR ART
FIG. 3 is a cross-sectional view illustrating a prior art apparatus and method of continuous pressure infiltration of wire.
Figure 6:
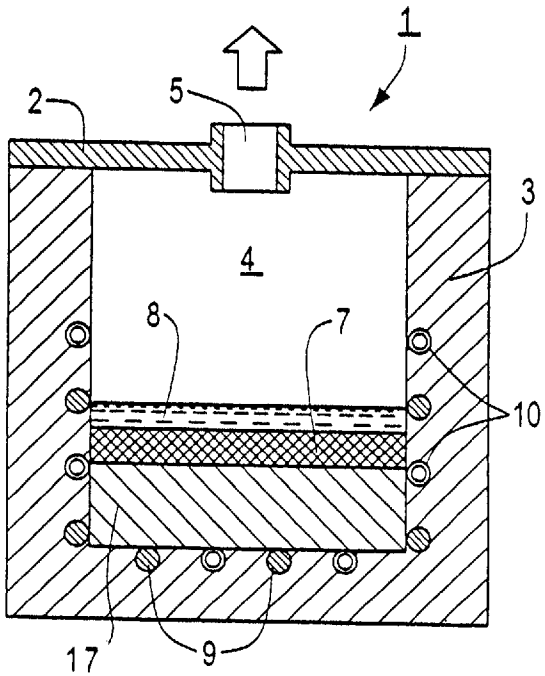
FIG. 6 is a schematic diagram of the method of FIG. 5 after completion of the steps illustrated by FIG. 5.
Figure 5:
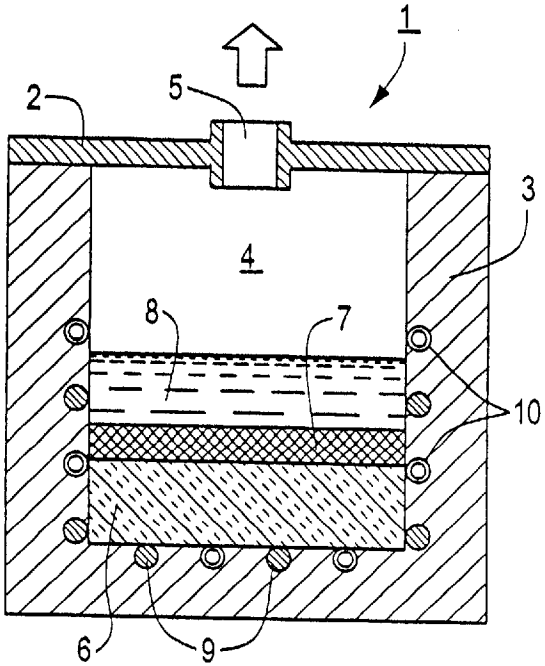
FIG. 5 is a schematic diagram of a method of manufacturing a composite material in a first embodiment of the present invention.
Figure 4:
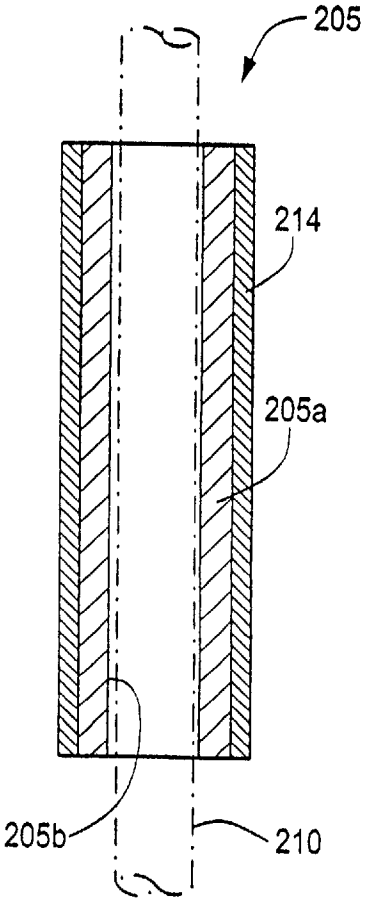
FIG. 4 PRIOR ART
FIG. 4 is a perspective view showing an orifice in the apparatus of FIG. 3.

Referring to FIGS. 5 and 6, a method of manufacturing a composite material according to a first embodiment of the present invention is described. In FIG. 5, a pressurizable container 1 is provided having a cylindrical container body 3 defining a charging chamber 4 with an open upper end. A closure section 2 is provided for closing the open upper end.

An operation hole 5 at the center of the closure section is provided for evacuating or pressurizing the pressure container. In the container body 3, heaters 9 and water-cooled tubes 10 are arranged alternately in the external peripheral wall of the charging chamber, as well as on the outer surface of the bottom of the charging chamber.

A predetermined amount of ceramic-based hollow particles 6, such as glass balloons with a mean particle size of 0.1 to 300 $\mu$m, preferably 10 to 100 $\mu$m, is placed in the charging chamber 4 from the open upper end of the container body. A ceramic-based heat-resistant filter 7 is secured on top of the ceramic-based hollow particles. The heat-resistant filter is formed from a porous mullite-based material. A metal binding agent 8 for the metal matrix, such as aluminum, is placed on top of the heat-resistant filter. In FIG. 5, the metal matrix is in a molten state.

The upper end of the container body 3 is closed with the closure section 2. The charging chamber is evacuated by connecting the operation hole 5 to an evacuating device such as a vacuum pump. The container body is heated to above the melting temperature of the infiltrating material, for example, 550 to 660° C., depending on the material.

As shown in FIG. 6, the upper surface of the metal matrix 8 is pressurized for a predetermined period of time at a predetermined pressure, for example, 5 to 10 kgf/cm$^2$, by connecting the operation hole to a supply line of an inert gas such as argon. The pressurization causes a flow of the metal matrix 8 through the heat-resistant filter 7 into the ceramic-based hollow particles, creating a metal matrix composite 17 in which gaps among the ceramic-based hollow particles are fully charged with the fused metal-based binding agent at a high charging ratio. In this state, the metal-based binding agent distributed throughout the composite material remains at a high temperature.

The interior space of the charging chamber is cooled rapidly to a predetermined temperature, not more than 100° C., such as by the water-cooled pipes 10, whereby the metal matrix becomes fine-grained, resulting in a light-weight, high-strength metal matrix composite. In this metal matrix composite, the ceramic-based hollow particles can be charged with the metal matrix at a charging ratio of 50 to 74% by volume.

Figure 7:
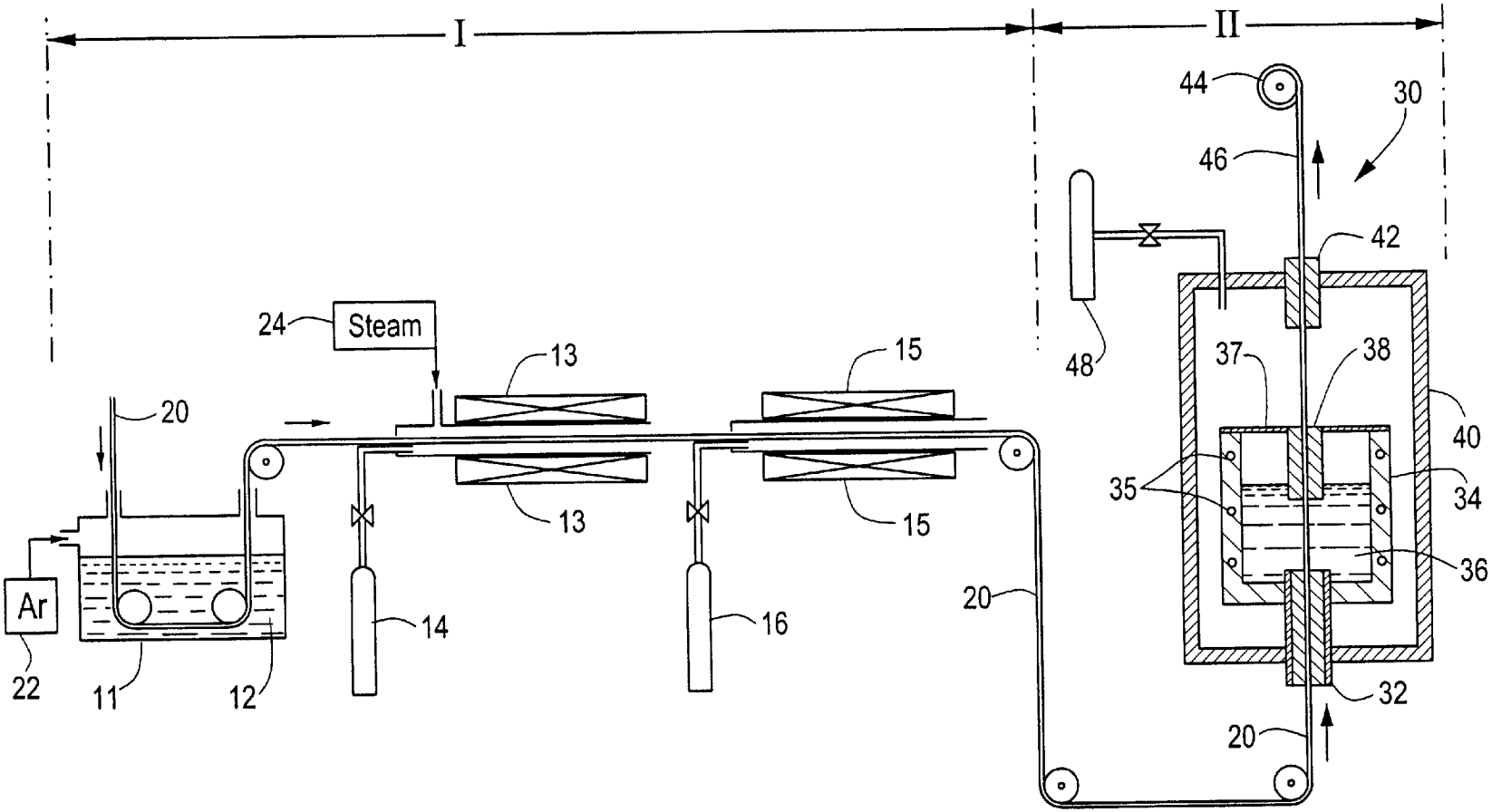
FIG. 7 is a schematic diagram of an embodiment for the production of a fiber-reinforced composite wire.

Referring to FIG. 7, a further embodiment of the present invention provides a method and apparatus for forming a fiber-reinforced metal matrix composite wire. In a first step, indicated by I in FIG. 7, inorganic fiber bundles are coated with a metal oxide. In a second step, indicated by II, the metal-oxide-coated inorganic fiber bundles are infiltrated with a metal to produce a fiber-reinforced metal matrix composite wire.

In step I, an organic metal compound solution 12 containing a hydrolyzable organic metal compound is provided in a suitable tank 11. Inorganic fiber bundles 20, which have been freed of fiber-surface coating materials, including sizing material, are immersed in the organic metal compound solution in the tank so that the organic metal compound is allowed to infiltrate fully into the gaps between the fibers constituting the bundles. Preferably, the tank is equipped with an ultrasonic wave generator by which the bundles of inorganic fibers are subjected to ultrasonic vibration to promote the infiltration of the organic metal compound into the gaps between the fibers. Furthermore, the tank is continuously supplied with a non-reacting gas such as argon or nitrogen from a suitable source 22 so that the air therein is replaced by the inert gas.

The organic metal compound solution 12 is an organic metal compound dissolved in an organic solvent. The organic metal compound may be properly selected based on the kind of inorganic fibers to be treated, the kind of coating metal, and the combination thereof. The organic metal compound undergoes a hydrolysis reaction so that it is converted to a metal oxide that renders the inorganic fibers wettable. Among metal oxides, silicon dioxide is a good agent to render inorganic fibers wettable, regardless of the kind of inorganic fibers or the coating metal used. Hence, it is preferable to use an organic silicon compound as the organic metal compound. Alkoxysilanes are particularly preferred among organic silicon compounds from the standpoint of hydrolyzability. Typical examples of such alkoxysilanes include tetramethoxysilane, tetraethoxysilane, and tetrabutoxysilane. An organic chloride may be additionally used to promote the hydrolysis of the organic metal compound. For example, if an alkoxysilane is used as an organic metal compound, it is preferable to also use silicon chloride. The organic solvent to be employed is not limited to a specific solvent as long as it dissolves the organic chloride therein. In practice, toluene is a preferred solvent if an alkoxysilane is used as the organic metal compound and silicon chloride is used as the organic chloride.

The formulation of the organic metal compound solution need not be specified exactly. For example, the organic metal compound solution may be made up of 0.5% by volume to 30% by volume of an organic metal compound, from 0.5% by volume to 30% by volume of an organic chloride, and the balance of an organic solvent.

The bundles of inorganic fibers into which the organic metal compound and the organic chloride have infiltrated are then passed through a heating oven 13. The heating oven is constantly supplied with steam (water vapor) from a source 24 so that the organic metal compound and the organic chloride that have infiltrated into the bundles of inorganic fibers are hydrolyzed. The heating oven is also supplied with a non-reacting gas such as argon or nitrogen from a gas supply source 14. The heating oven is kept at a preset temperature, about 80 to 100° C., so that the hydrolysis reaction involving the organic metal compound and the organic chloride proceeds effectively. Subsequently, the bundles of inorganic fibers are passed through a further heating oven 15 for pyrolysis, in which the hydrolyzate of the organic metal compound and the organic chloride are converted to metal oxides. The further heating oven is kept at a preset temperature between 200 and 750° C., preferably about 700° C., so that the organic solvent, water, the surplus organic metal compound, and the organic chloride are all vaporized. The heating oven is continuously supplied with a non-reacting gas such as argon or nitrogen from a gas supply source 16. The foregoing hydrolysis reaction of the organic metal compound and the organic chloride proceeds throughout the bundles of inorganic fibers. Thus, this heat treatment causes metal oxides to be uniformly produced within the bundles of inorganic fibers.

In the foregoing pretreatment step I, the bundles of inorganic fibers are conveyed at a suitable speed so that both hydrolysis and pyrolysis can proceed effectively.

The bundles of inorganic fibers 20 that have been subjected to the pretreatment are then passed to the second step, step II, of metal infiltration. The second step is effected using the pressure infiltration apparatus 30 shown in FIG. 7, in which the bundles of inorganic fibers are introduced through an entering orifice 32 into a bath container 34 where they are brought into contact with a molten metal 36 for pressure infiltration. The bath container includes heaters 35 and a closure 37. The fiber bundles then exit from the bath container through an intermediate orifice 38, which peels off excess molten metal and prevents surface impurities from adhering to the fiber. From a pressure chamber 40, the fiber bundles pass through an exit orifice 42, to be taken up by a winding bobbin 44 as a fiber-reinforced metal matrix composite wire 46. A gas supply source 48, for example, of argon or nitrogen, is provided to supply a pressurized gas to the bath container and the pressure chamber.

In this two-step arrangement, various kinds of fiber-reinforced metal matrix composite wires can be produced depending on the kind of inorganic fibers and of the molten metal. The bundles of inorganic fibers may be of carbon fibers; or ceramic fibers made of boron, aluminum oxide, silicon carbide or other ceramics; or of metal fibers made of tungsten or other metals. Also, the molten metal may be aluminum, titanium, chromium, cobalt, zinc, tin, copper or their alloys, or superalloys of nickel, chromium, or cobalt.

Figure 8:
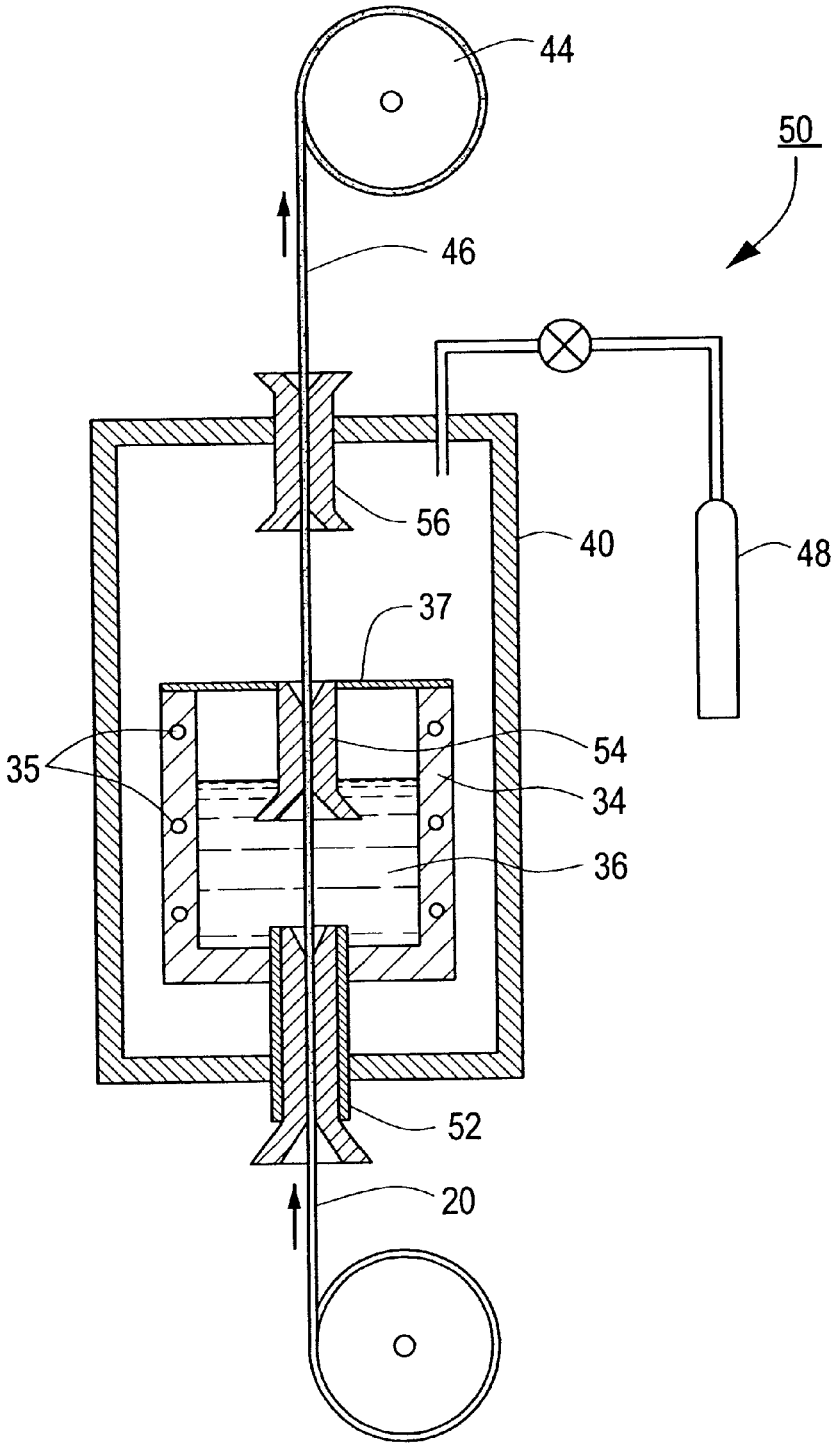
FIG. 8 is a cross-sectional view of the apparatus of the present invention for the continuous pressure infiltration of wire.

In a further apparatus 50 of the present invention, one or more of the orifices 52, 54, 56 is provided with an enlarged diameter section formed at least at the entrance of the orifice where the inorganic fibers 20 are introduced into the orifices. See FIGS. 8–10. The apparatus 50 is otherwise similar to the apparatus 30 described above, and the same reference numerals are used to identify like elements. It will be appreciated that the apparatus 50 may be used alone or in conjunction with the apparatus and method of step I described above.

Figure 9:
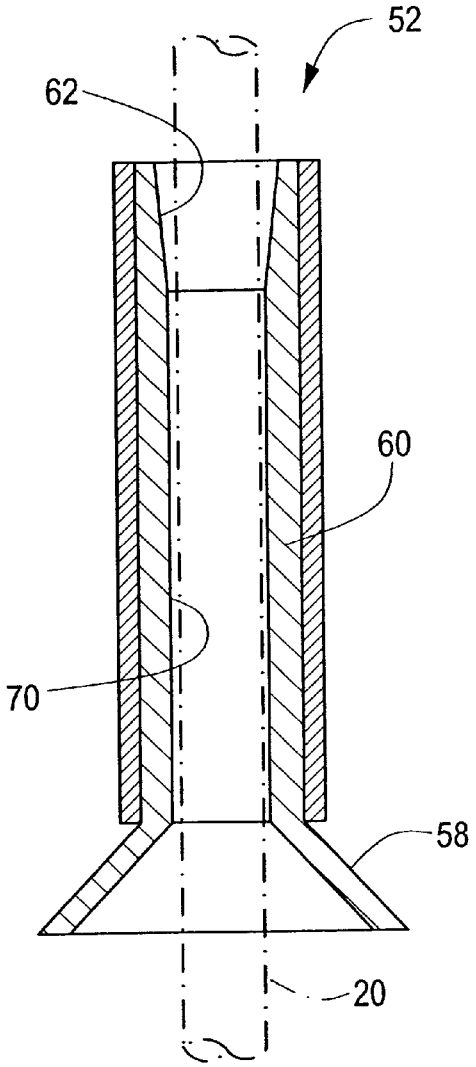
FIG. 9 is a cross-sectional view of a first embodiment of an orifice for use in the apparatus of FIG. 8.
Figure 10:
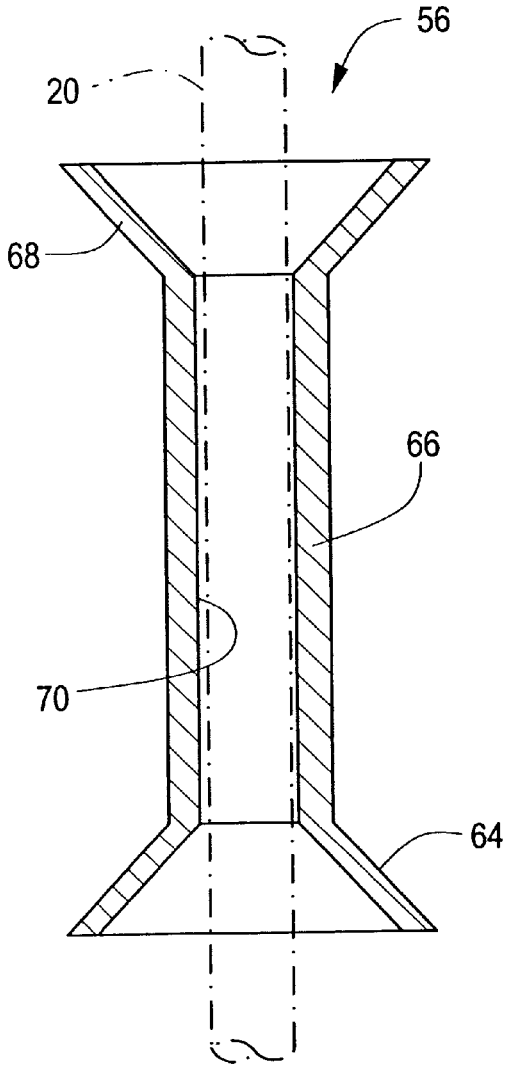
FIG. 10 is a cross-sectional view of a further embodiment of an orifice for use in the apparatus of FIG. 8.

Referring more particularly to FIG. 9, the enlarged diameter section is preferably provided by a conical portion 58 that converges toward an intermediate body portion 60 of the orifice. In this manner, the fibers can be more readily inserted and guided into the orifices. Also, the exit of one or more of the orifices may also be enlarged by providing a conical portion 62 that diverges from the intermediate portion. In the embodiment illustrated more particularly in FIG. 9, the enlarged diameter section is formed by flaring the body portion of the orifice outwardly from the intermediate body portion 60. The enlarged diameter section at the exit is formed by a tapered widening of the interior surface of the passageway through the orifice. In a further embodiment, illustrated more particularly in FIG. 10, the exit is formed with a conical portion 68 diverging from the intermediate section 66, similar to the flared walls of the conical portion 64 at the entrance. This conical portion 68 minimizes vibrations of the fiber from gas passing through the orifice, which would otherwise tend to cut off the fiber bundles.

The interior surface 70 of the passageway is also preferably finished with a mirror finish. A mirror finish assists in smooth insertion of the fiber bundles through the orifice.

The material of the orifices is selected to have a low reactivity with both the molten metal and the inorganic fiber bundles. Preferably, the orifices are formed from stainless steel, tantalum, molybdenum, platinum, tungsten, or sintered zirconia-ceramic-based materials.

In a still further embodiment of the present invention, the apparatus includes a pressure chamber 72 and a bath container 74 for a molten metal 76. See FIG. 11. The bath container 74 is heated by a heater 78 and is equipped with an entering orifice 80 and an intermediate orifice 82 for passing inorganic fiber bundles 84 through the bath container. The orifices 80, 82 are respectively connected to an entering orifice 86 and an exit orifice 88 of the pressure chamber 72. The pressure in the pressure chamber is sufficiently low, for example, from 20 to 50 psi, to more readily control or prevent any blow out of the molten material through the orifices. An ultrasonic wave generating device 90 is connected to the pressure chamber 72 with a vibration-emitting transducer, the end 92 of which is immersed in the molten metal 76. The end is made of a ceramic material that does not react with the molten metal. The ultrasonic wave generating device is connected to a controller 94 for vibration frequency, output, etc. The pressure chamber 72 is supplied with a non-reacting gas such as argon or nitrogen from a gas supply source 95 so that the interior of the pressure chamber 72 is kept at a preset pressure in order to pressurize the molten metal during metal infiltration. If necessary, cooling water W may be passed through the sealing part 91 of the pressure chamber 72 as well as the ultrasonic wave generating device 90.

In operation of the apparatus of the present invention, inorganic fiber bundles 84 that have been freed of sizing materials are continuously fed from a delivery bobbin 83 through the entering orifice 80 into the bath container 74 where they are brought into contact with the molten metal 76. Because both the inorganic fiber bundles 84 and the molten metal 76 are under the application of the ultrasonic vibration, the molten metal 76 can infiltrate more readily into the bundles of inorganic fibers. Accordingly, inorganic fiber bundles are fully infiltrated by the metal, forming a fiber-reinforced metal matrix composite wire 96, which is discharged out of the apparatus through the exit orifice 82 and then taken up by the winding bobbin 85.

Using the apparatus of the present invention, various kinds of fiber-reinforced composite wire 96 can be produced depending on the combination of bundles of inorganic fibers 84 and molten metal 76 used. The bundles of inorganic fibers may be of carbon fibers; of ceramic fibers made of boron oxide, aluminum oxide, silicon carbide, or other ceramic materials; or of metal fibers made of tungsten or other metals. The molten metal may be aluminum, titanium, chromium, cobalt, zinc, tin, copper or their alloys; or superalloys of nickel, chromium, or cobalt.

The present invention will be further described in the following operational example with and without the application of ultrasonic vibration.

Figure 11:
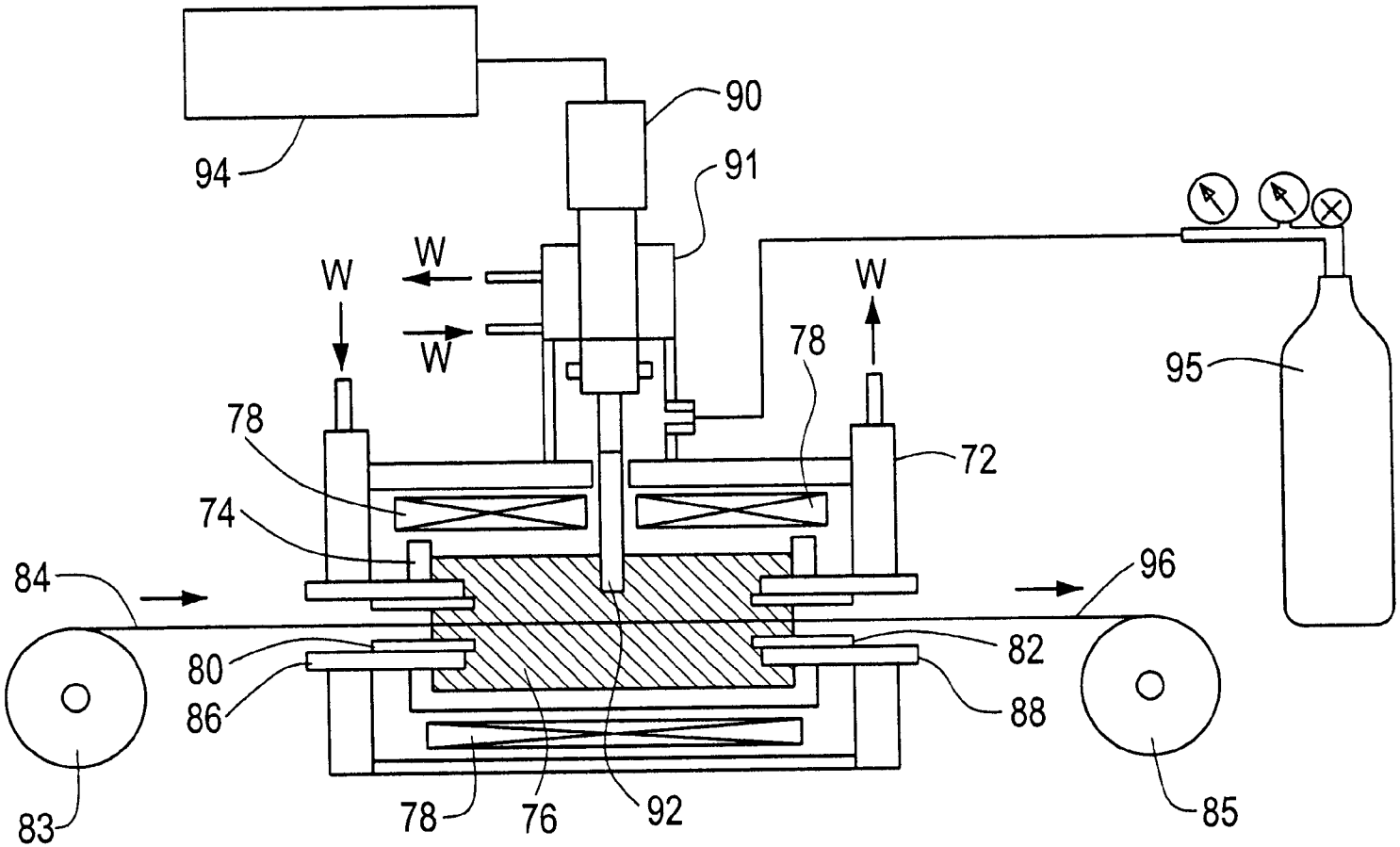
FIG. 11 is a schematic diagram of a further embodiment of an apparatus for the continuous production of composite wire.
Figure 12:
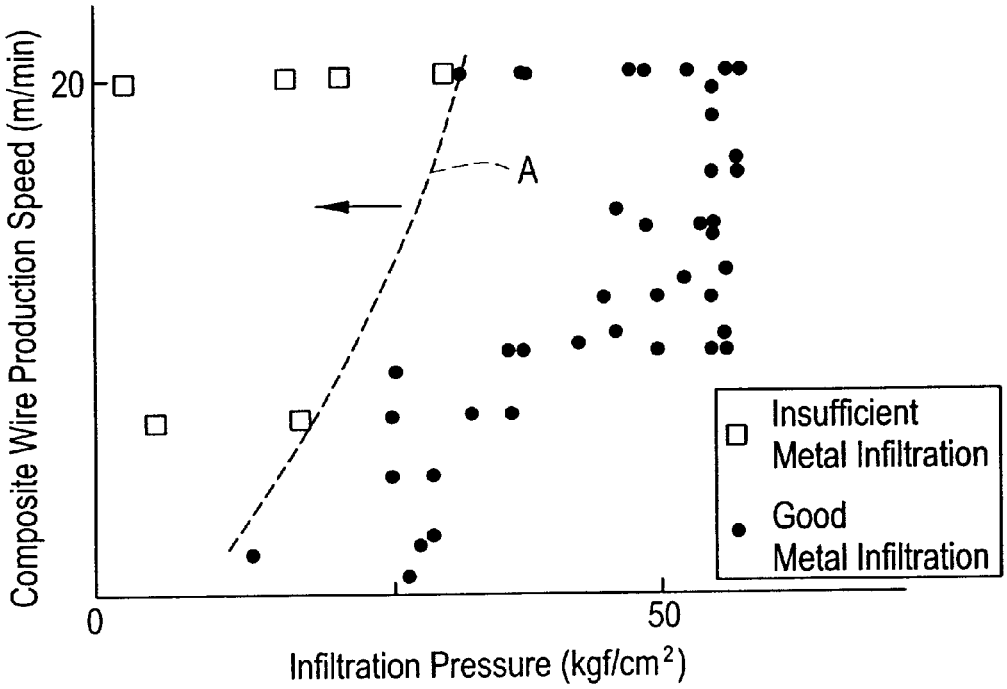
FIG. 12 illustrates the relationship between composite wire production speed and infiltration pressure.

Desized carbon fiber bundles were directly fed into the apparatus of FIG. 11, where they were infiltrated by copper to produce copper-infiltrated bundles of carbon fibers. The infiltration conditions of the carbon fiber bundles were inspected for each run as both the wire-processing speed and the infiltration pressure were varied systematically. FIG. 12 illustrates the results, in which the broken line A indicates an approximate boundary between good copper-infiltration runs (indicated by filled circles) and insufficient copper-infiltration runs (indicated by squares).

Figure 13:
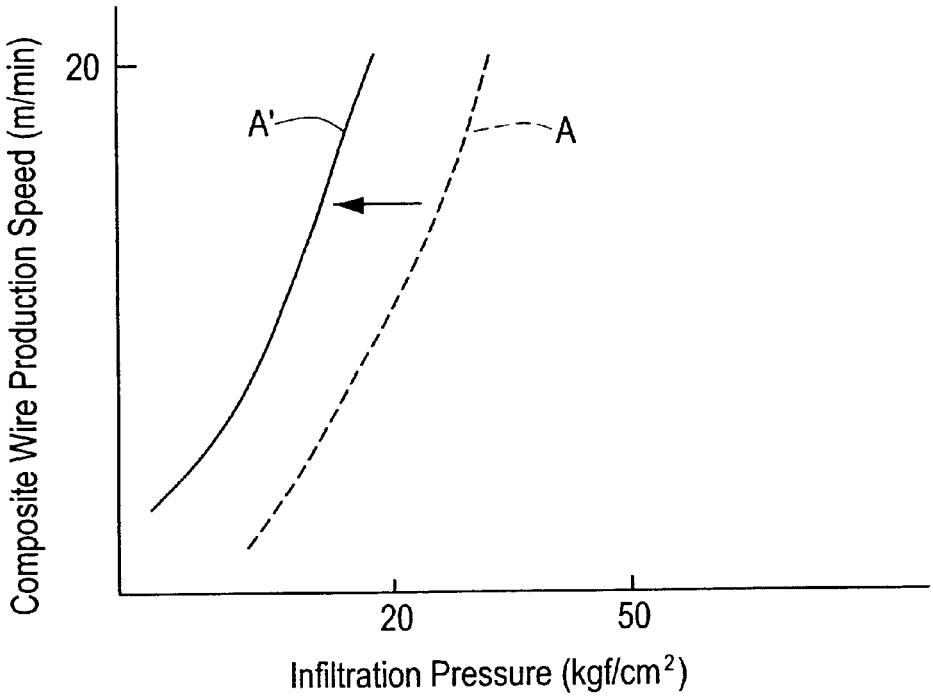
FIG. 13 illustrates the relationship between composite wire production speed and infiltration pressure showing the shift in the boundary line due to ultrasonic vibration.

Using the apparatus shown in FIG. 11, desized carbon fiber bundles were continuously immersed into molten copper under application of ultrasonic vibration having an output of 1.5 kW at a frequency of 20 kHz to produce copper-coated carbon fiber bundles. The same infiltration inspections as the above-mentioned comparative example revealed, as illustrated in FIG. 13, that the boundary line shifted from a line indicated by A (without the application of ultrasonic vibration) to a line indicated by A' (under the application of ultrasonic vibration), implying that the metal infiltration is promoted by ultrasonic vibration, which in turn leads to a cost reduction associated with the consumption of the pressurizing gas as well as the required strength and the fabrication of the pressure chamber, and an improvement in the durability of the whole apparatus.

The invention is not to be limited by what has been particularly shown and described, except as indicated by the appended claims.

What is claimed is:

1. A method for the production of inorganic fiber-reinforced metal matrix composite wires comprising:

dipping inorganic fiber bundles in a solution of a hydrolyzable organic metal compound;

hydrolyzing and heat-treating the organic metal compound so that the inorganic fiber surfaces are coated with a metal oxide; and infiltrating under pressure a molten metal into the inorganic fiber bundles.

2. The method of claim 1, wherein in the infiltrating step, the molten metal comprises aluminum, an aluminum alloy, titanium, a titanium alloy, chromium, a chromium alloy, cobalt, a cobalt alloy, zinc, a zinc alloy, tin, a tin alloy, copper, a copper alloy, a superalloy of nickel, a superalloy of chromium, or a superalloy of cobalt.

3. The method of claim 1, wherein in the dipping step, the organic metal compound comprises a metal alkoxide.

4. The method of claim 1, wherein in the dipping step, the organic metal compound comprises an alkoxysilane.

5. The method of claim 4, wherein the alkoxysilane comprises tetramethoxysilane, tetraethoxysilane, or tetrabutoxysilane.

6. The method of claim 1, wherein in the dipping step, the solution includes a metal chloride.

7. The method of claim 1, wherein in the dipping step, the solution includes toluene.

8. The method of claim 1, wherein in the hydrolyzing step, further comprising passing the inorganic fiber bundles through a heating oven in the presence of water vapor.

9. The method of claim 1, further comprising providing the inorganic fiber bundles as carbon fibers, ceramic fibers, or metal fibers.

10. The method of claim 1, further comprising providing the inorganic fiber bundles as ceramic fibers comprising aluminum oxide or silicon carbide.

11. The method of claim 1, further comprising providing the inorganic fiber bundles as metal fibers comprising tungsten fibers.

* * * * *

UNITED STATES PATENT AND TRADEMARK OFFICE

CERTIFICATE OF CORRECTION

PATENT NO. : 6,779,589 B2
APPLICATION NO. : 10/373979
DATED : August 24, 2004
INVENTOR(S) : Joseph T. Blucher et al.

It is certified that error appears in the above-identified patent and that said Letters Patent is hereby corrected as shown below:

Title page, Item (75) Inventors, line 2, "Susono (JP)" should read --Susono City (JP)--;

Title page, Item (73) Assignees, line 1, "Shizuoka (JP)" should read --Susono, Shizuoka (JP)--;

Signed and Sealed this

Twenty-ninth Day of August, 2006

JON W. DUDAS
*Director of the United States Patent and Trademark Office*